US005784838A

United States Patent [19]

Phillips

[11] Patent Number: 5,784,838

[45] Date of Patent: Jul. 28, 1998

[54] DRAIN FOR DRAINING WATER FROM A BASEMENT FLOOR

[76] Inventor: Jeffery L. Phillips, 118 Logtown Rd. Ext., Fultonville, N.Y. 12072

[21] Appl. No.: 828,426

[22] Filed: Mar. 28, 1997

[51] Int. Cl.[6] ..... E02D 19/00

[52] U.S. Cl. ..... 52/169.5; 52/169.14; 52/302.1; 405/44

[58] Field of Search ..... 52/169.5, 169.14, 52/98, 302.1, 302.3, 274; 405/43, 45, 44, 48, 36

[56] References Cited

U.S. PATENT DOCUMENTS

| | | | |
|---|---|---|---|
| 2,581,521 | 1/1952 | Davis . | |
| 3,283,460 | 11/1966 | Patrick . | |
| 3,287,866 | 11/1966 | Belvilacqua . | |
| 3,332,185 | 7/1967 | Adams . | |
| 3,613,323 | 10/1971 | Hreha . | |
| 3,850,193 | 11/1974 | Guzzo . | |
| 3,852,925 | 12/1974 | Gazzo . | |
| 3,975,467 | 8/1976 | Beck . | |
| 4,075,800 | 2/1978 | Molick | 52/302.3 |
| 4,185,429 | 1/1980 | Mendola . | |
| 4,245,443 | 1/1981 | Beechen . | |
| 4,265,064 | 5/1981 | Parezo . | |
| 4,333,281 | 6/1982 | Scarfone . | |
| 4,381,630 | 5/1983 | Koester . | |
| 4,590,722 | 5/1986 | Bevelacqua | 52/169.5 |
| 4,745,716 | 5/1988 | Kuypers . | |
| 4,773,195 | 9/1988 | Waller | 52/169.5 |
| 4,837,991 | 6/1989 | Shaw . | |
| 4,869,032 | 9/1989 | Geska . | |
| 4,879,851 | 11/1989 | Boccia . | |
| 5,277,003 | 1/1994 | Myers . | |
| 5,501,044 | 3/1996 | Janesky . | |

*Primary Examiner*—Creighton Smith
*Attorney, Agent, or Firm*—Michael W. Starkweather

[57] ABSTRACT

A basement wall drain unit that extends around the periphery of a basement next to the wall for draining away any potentially damaging moisture. The drain fits securely to a foundation wall before a concrete floor is poured in a basement. The drain further has a removable cap. The cap being removed after the concrete floor has been poured and hardened. The cap is for preventing wet concrete from filling the drain during installation of the basement floor or the like. Another feature of the invention is to provide a device and method that have spaced apart drainage holes in a channel for draining water from the basement area to a location under the basement floor.

13 Claims, 2 Drawing Sheets

DRAIN FOR DRAINING WATER FROM A BASEMENT FLOOR

BACKGROUND OF THE INVENTION

1. FIELD OF THE INVENTION

This invention relates to a basement wall drain unit. In particular, there is drain extending around the periphery of a basement next to the wall for draining away any potentially damaging moisture.

2. DESCRIPTION OF THE RELATED ART

Moisture is known to collect in the interior of basement walls and to run down the inner surface of basement walls due to a multitude of causes, like seepage through the walls from the surrounding ground. The presence of such moisture is disadvantageous, tending to prevent basements from being fully used as living, or recreational areas.

Examples of patents related to the present invention are as follows, and each patent is herein incorporated by reference for the supporting teachings:

U.S. Pat. No. 5,501,044, is a sub-floor water control drainage conduit element and system that minimizes installation labor, materials and time. the drainage conduit element comprises an elongate conduit section that is somewhat hemispherical or somewhat rectangular in cross-section and has a flat base on floor wall, and a roof wall and/or sidewall. The floor wall is designed to be supported on the top surface of a footing at the wall-footing interface or in an excavation at the base of a wall. The conduit section is open to admit groundwater, such as from the wall-footing interface, and the element contains an upper vertical wall portion designed to extend above the basement floor surface and is spaced from the basement wall to provide a wall drain gap down to the conduit section.

U.S. Pat. No. 5,277,003, is a vacuum system sued for preventing radon gas from entering the basement of a home. The gas is drawn from the interior of the basement walls, the exterior of the basement walls and from underneath the floor into a drain tile under the floor where the gas is then evacuated to vent pipes extending to the top of the home where the gas is vented to the atmosphere.

U.S. Pat. No. 4,265,064, is a system for new or old construction involving the installation of channels of water impermeable material along the juncture between the floor slab and the adjoining exterior walls, immediately beneath and substantially flush with the interior wall paneling components used to finish the interior of the exterior walls. the channels provide for the direct collection and removal of seepage water or the like coming through the exterior walls.

U.S. Pat. No. 4,381,630, is a foundation vent structure positioned upon the footing of a building below the lowermost row of concrete blocks of the basement wall and extends below the concrete floor of the basement. The vent structure is formed of a plastic material, preferably in strips, and is shaped to define alternate tunnels and channels having openings therein.

U.S. Pat. No. 4,745,716, is a product useful for preventing water seepage onto a floor in a structure having a foundation, a footing, a floor and a drain below the floor.

U.S. Pat. No. 4,837,991, is a hydro channel for use in conjunction and in proximity with the juncture between a foundation wall, and the upper surface of a connecting footing. The channel incorporating an angled portion, formed of a horizontal and vertical integral wall. A lower flange extends from the bottom edge of the vertical wall. A breakaway upright flange extends integrally from the upper edge of the upper wall, and once a concrete floor or slab is poured, and hardened, part of the upright flange may be broken away to align its upper edge in proximity with the upper surface of the constructed floor.

U.S. Pat. No. 4,185,429, is a drainage system located in a trench formed about the inner periphery of a foundation. The drainage system comprises a plurality of interconnected pipes, each positioned and pitched to allow water entering the pipes to flow to a collection site. The pipes comprise a longitudinal tubular member having a top wall with a central section containing a plurality of apertures. The top wall has a first sloping section that slopes form one end towards the central portion at a given angle and slopes from the other end towards the central portion at the same angle to enable any water directed on the surface to flow into the apertures on the central portion of the pipe.

U.S. Pat. No. 4,869,032, is a drainage control apparatus for basements having a poured concrete floor. A plurality of drainage structures each has a vertical leg and a horizontal leg, with the vertical leg being positioned proximate to the vertical side wall of the basement and the horizontal leg resting upon the top of the foundation footing. The vertical leg includes a plurality of outwardly protruding embossments proximate the bottom end of the vertical leg.

U.S. Pat. No. 4,245,443, is an arrangement for preventing seepage through a wall from running onto the poured concrete floor of a basement or the like, comprises a vertical channel member positioned between the wall and the floor and having spaced flat surfaces spaced from the wall, and a water impermeable facing strip abutting the flat surfaces spaced from the wall and against which the concrete floor is poured.

U.S. Pat. No. 4,879,851, is a kick-molding and drainage system for below grade floating platform structures wherein a trench is dug into the ground between vertically extending walls and a concrete floating floor spaced therefrom to form a seepage channel.

U.S. Pat. No. 4,333,281, is a basement wall drain unit for removing moisture from a basement wall formed of concrete blocks resting on a footing adjacent a concrete basement floor, wherein the concrete floor is poured against the drain unit so that a space is formed between the drain unit and an inner surface of the wall and between the drain unit and the footing into which moisture may drain from the interior of the wall through drain passages in the wall and then down beneath the basement floor to a weeping drain.

U.S. Pat. No. 3,975,467, is a drainage system preferably to eliminate wet and damp basements formed from an inexpensive, easily assembled pair of sheet metal members.

U.S. Pat. No. 3,852,925, is a tile trench formed along the footing of the leaking exterior wall by removing part of the floor adjacent the wall.

U.S. Pat. No. 3,850,193, is a combination drain conduit and expansion joint for foundation walls, which conduit is of stepped formation with the respective end flanges resting against a footer and a first course of concrete or cinder blocks.

U.S. Pat. No. 3,613,323, is a form intended for use in the casting of concrete or cement foundations which have a drain tile integral with an element thereof.

U.S. Pat. No. 3,283,460, is an L-shaped means for damp proofing basements forming passageways between foundation floor and walls.

U.S. Pat. No. 3,287,866, is a foundation wall such as found in dwelling house basements and the like having the floor incorporating a drainage means.

U.S. Pat. No. 3,332,185, is a method and apparatus for water proofing basements.

U.S. Pat. No. 2,948,993, is a drain construction for walls for draining away seepage from the basement floor.

U.S. Pat. No. 2,581,521, is a building construction for protecting buildings against termites or the like.

The foregoing patents reflect the state of the art of which the applicant is aware and are tendered with the view toward discharging applicants' acknowledged duty of candor in disclosing information that may be pertinent in the examination of this application. It is respectfully stipulated, however, that none of these patents teach or render obvious, singly or when considered in combination, applicants' claimed invention.

SUMMARY OF THE INVENTION

It is a feature of the invention to provide a basement wall drain unit. In particular, there is drain extending around the periphery of a basement next to the wall for draining away any potentially damaging moisture.

An additional feature of the invention is to provide a device and method that fits securely to a foundation wall before a concrete floor is poured in a basement.

A further feature of the invention is to provide a device and method that have a removable cap. The cap being removed after the concrete floor has been poured and hardened. The cap is for preventing wet concrete from filling the drain during installation of the basement floor or the like and other construction debris.

Another feature of the invention is to provide a device and method that have spaced apart drainage holes in a channel for draining water from the basement area to a location under the basement floor.

Still a further feature of the invention is to provide for full structural bearing of the floor/slab to the foundation while providing drainage.

The invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention so that the detailed description thereof that follows may be better understood, and so that the present contribution to the art may be better appreciated. There are, of course, additional features of the invention that will be described hereinafter which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims are regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, neither is it intended to be limiting as to the scope of the invention in any way.

Other features of the present invention will become more clear from the following detailed description of the invention, taken with the accompanying drawings and claims, or may be learned by the practice of the invention.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the use of the accompanying drawings.

Charter by the U.S. Constitution

This disclosure of the invention is submitted in furtherance of the constitutional purposes of the United States Patent Laws "to promote the progress of science and useful arts," as stated in Article 1, Section 8 of the United States Constitution.

DETAILED DESCRIPTION OF THE PREFERRED EMBODIMENT

Figure 1:
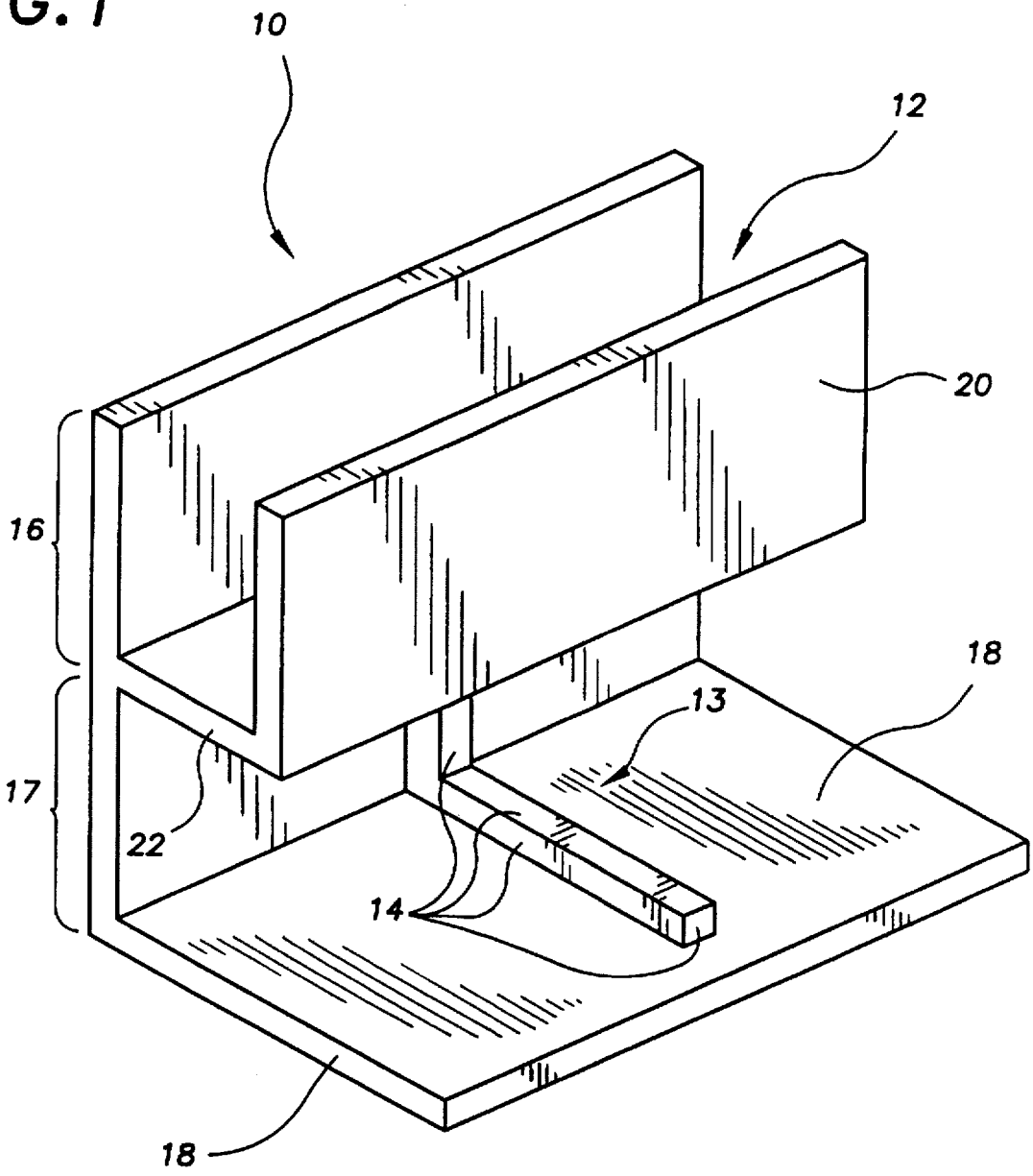
FIG. 1 is a perspective view of the preferred embodiment.

Referring to FIG. 1, there is a short section of a perspective view of the preferred embodiment, drain 10, having the following elements: There is a channel 12, one of many drain tubes 13, a drain tube top wall 14, back wall 16, a connecting wall 17 extending below the channel 12 co-planer with the back wall 16, connecting base 18, front channel wall 20, and channel bottom 22. The channel 12 is made up of back wall 16, channel wall 20, and the channel bottom 22.

Figure 2:
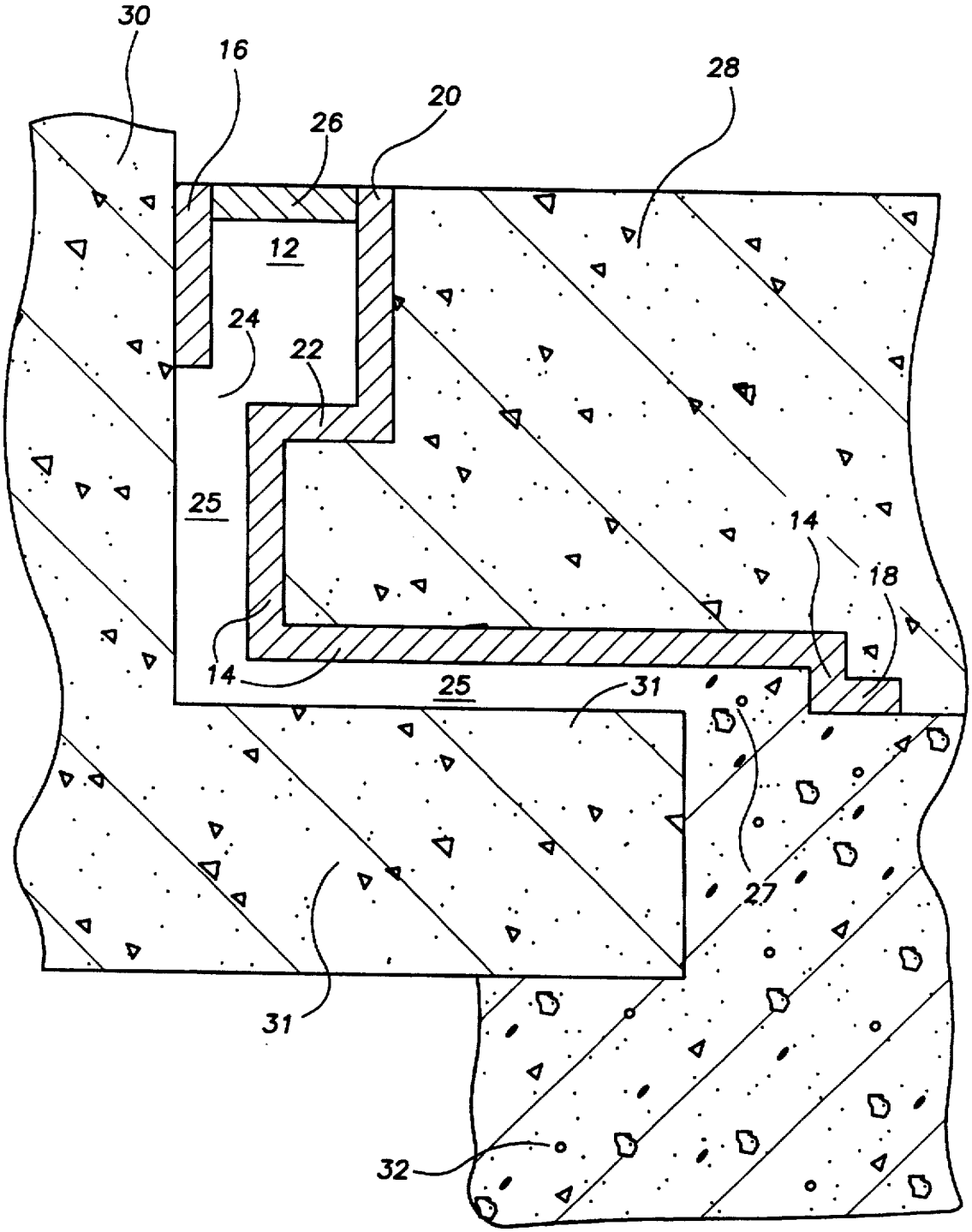
FIG. 2 is a cross-sectional view of the preferred embodiment of FIG. 1 taken along the drain hole and tube.

Referring to FIG. 2, there is a cross sectional view taken at the drain tube 13 illustrating the following additional elements: There is a drain entrance hole 24 located in the bottom of channel 12, drain tube 25, removable drain cap 26, drain tube exit hole 27, concrete floor 28, concrete wall 30, concrete wall base 31, and ground support material 32.

In operation, the concrete wall 30 will be in place and the drain 10 may be inserted or placed in long lengths extending along the base of the wall. The basement floor slab 28 may then be poured into the basement over the ground support material 32. The drain cap 26 may prevent wet concrete from filling the channel 12. The concrete basement floor material 28 may be leveled by using the top edge of the drain 10 as a guide. When the concrete floor is dry, the drain cap 26 may be removed. Thereafter, any water formed in the basement will be collected in the channel 12 and directed toward drain entrance holes 24, directed down and along drain tube 25, exit drain tube exit hole 27, and expelled into the basement floor support material 32 and sub-surface drain system to a sump or day light. Alternatively, the drain 10 may be formed along the sides of pre-fabricated floor slabs 28 prior to installing into basements.

Remarks About the Preferred Embodiment

One of ordinary skill in the art of constructing basements, pouring basements, and repairing water leaks in basements will realize many advantages from using the preferred embodiment. For example, the shape of the base 18 around the tube 14 will ensure that the exit hole 27 will not get plugged during the placement of the drain 10 nor during the pouring of the concrete floor 28. Equally advantageous, is the placement of the exit hole 27 in a position that extends beyond the wall base 31. Another advantage of the preferred embodiment is that there is no back or bottom wall at the drain tube 14, 24, 25, and 27 location; the concrete wall 30 and base 31 form the needed support structure.

The simplicity of the design is illustrated by the replacement of the connecting wall 17 and the connecting base 18, at the drain tube 25 location, with the concrete wall 30, concrete wall base 31.

Variations of the Preferred Embodiment

One of ordinary skill will notice that there is only one drain tube 14, 25 illustrated, but obviously there would be many such drain tubes spaced along the length of the drain 10. Additionally, a skilled artisan would consider it to be an obvious design change to make the whole drain 10 with rounded corners for ease of fabrication. Similarly, channel 12 could have portions that are slanting toward the drain entrance holes 24 to assist in proper drainage of water. Another modification contemplated by the inventor, is to place a concrete nail into the base 17 or 18 for securing the drain during the pouring of the concret floor. A further modification is to have any general shape to the drain so that it fits against a foundation or wall structure tightly.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by United States Patent is:

1. A drain for draining water from a basement floor or foundation, comprising:

a) a channel having a vertical back wall, a vertical front wall parallel to the back wall, and a bottom wall perpendicular to the front and back walls and connected between the front and back walls to form a base of the channel;

b) a connecting wall extending below the channel and co-planer with the back wall, having a front and back surface;

c) a connecting base extending parallel to and spaced from the bottom wall, and connected to one end of the connecting wall, the connecting base having a front and back surface; and d) a drain tube being perpendicular to the channel, extending from the bottom wall, through the connecting wall and connecting base, and forming a void along the back surfaces of both the connecting wall and the connecting base.

2. The drain of claim 1, wherein the channel includes a removable cover.

3. The drain of claim 2, wherein the drain includes more than one drain tube.

4. A drain system for draining water from a basement floor, comprising:

a) a building wall and footing;

b) a floor;

c) a channel, mounted against the building wall and on the footing, having a vertical back wall, a vertical front wall parallel to the back wall, and bottom wall perpendicular to the front and back walls and connected between the front and back walls to form a base of the channel;

b) a connecting wall extending below the channel and co-planer with the back wall, having a front and back surface;

c) a connecting base extending parallel to and spaced from the bottom wall, and connected to one end of the connecting wall, the connecting base having a front and back surface; and d) a drain tube being perpendicular to the channel, extending from the bottom wall, through the connecting wall and connecting base, and forming a void along the back surfaces of both the connecting wall and the connecting base.

5. The drain system of claim 4, wherein the channel includes a removable cover.

6. The drain system of claim 4, wherein the drain includes more than one drain tube.

7. A drain for draining water from a basement floor, comprising:

a) a connecting base having a top and bottom surface;

b) a connecting wall substantially perpendicular to the connecting base, and having a top and bottom surface;

c) a channel, mounted on the connecting wall, for collecting moisture; and d) a drain tube, coupled to receive moisture from the channel, extending into the connecting wall and connecting base so as to form a void along the bottom surface of the connecting wall and the connecting base.

8. The drain of claim 7, wherein the channel includes:

a) a vertical back wall, b) a vertical front wall parallel to the back wall, and c) a bottom wall perpendicular to the front and back walls and connected between the front and back walls to form a base of the channel.

9. The drain of claim 8, wherein the connecting wall extends below the channel and co-planer with the back wall.

10. The drain of claim 9, wherein the connecting base extends parallel to and spaced from the bottom wall, and connected to one end of the connecting wall.

11. The drain of claim 10, wherein the drain tube having:

a) a first section, being perpendicular to the channel and extending from the bottom wall, through the connecting wall; and b) a second section extending from and perpendicular to the first section and being coplainer with the connecting base.

12. The drain of claim 7, wherein the channel includes a removable cover.

13. The drain of claim 12, wherein the drain includes more than one drain tube.

* * * * *